United States Patent [19]

Keat

[11] 4,157,897

[45] Jun. 12, 1979

[54] CERAMIC BONDED GRINDING TOOLS WITH GRAPHITE IN THE BOND

[75] Inventor: Paul P. Keat, Holden, Mass.

[73] Assignee: Norton Company, Worcester, Mass.

[21] Appl. No.: 879,654

[22] Filed: Feb. 21, 1978

Related U.S. Application Data

[63] Continuation of Ser. No. 787,464, Apr. 14, 1977, abandoned, which is a continuation-in-part of Ser. No. 671,943, Mar. 30, 1976, abandoned, which is a continuation-in-part of Ser. No. 255,559, May 22, 1972, abandoned, which is a continuation-in-part of Ser. No. 876,707, Nov. 14, 1969, abandoned.

[51] Int. Cl.[2] ..... B24D 3/14; B24D 7/06

[52] U.S. Cl. ..... 51/295; 51/308

[58] Field of Search ..... 51/295, 298, 307, 308

[56] References Cited

U.S. PATENT DOCUMENTS

| | | | |
|---|---|---|---|
| 3,081,161 | 3/1963 | Cantrell | 51/308 |
| 3,383,191 | 5/1968 | Thomas | 51/298 |
| 3,454,384 | 7/1969 | Kumagai | 51/308 |
| 3,650,714 | 3/1972 | Farkas | 51/308 |
| 3,664,819 | 5/1972 | Sioui et al. | 51/298 |
| 3,819,387 | 6/1974 | Leger et al. | 51/308 |

*Primary Examiner*—Donald J. Arnold
*Attorney, Agent, or Firm*—Rufus M. Franklin

[57] ABSTRACT

Ceramic bonded grinding and honing tools employing diamond or cubic boron nitride abrasive particles are improved by the inclusion of from 10 to 53%, by volume, of graphite in the bond, based on the total bond solids, including graphite. The bond must have a porosity volume less than 15% for honing applications and less than 10% for grinding wheels, preferably the graphite should be finely particulate. Applications in dry grinding and honing of hard materials are described. For dry grinding the optimum graphite content of the bond is from 34 to 45 volume percent. The bond may include crystalline filler such as alumina, zirconia, silicon carbide, or crystalline filler formed in situ by devitrification; and the abrasive particles may be metal coated. $MoS_2$ or hexagonal boron nitride may substitute for all or part of the graphite and metal powders may be employed to replace up to 50% by volume of the graphite or graphite substitute materials.

9 Claims, 3 Drawing Figures

CERAMIC BONDED GRINDING TOOLS WITH GRAPHITE IN THE BOND

This is a continuation of application Ser. No. 787,464 filed Apr. 14, 1977 now abandoned, which is a continuation-in-part of Ser. No. 671,943 filed Mar. 30, 1976, now abandoned, which is a continuation-in-part of Ser. No. 255,559, filed May 22, 1972, now abandoned, which is a continuation-in-part of Ser. No. 876,707, filed Nov. 14, 1969, now abandoned.

FIELD OF THE INVENTION

The invention relates to ceramic (e.g. glass) bonded honing and grinding tools employing the ultra-hard abrasives: diamond and cubic boron nitride. The invention makes practical, for the first time, the use of ceramic bonded diamond wheels in the dry grinding of cemented carbide tools.

BACKGROUND OF THE INVENTION

In the grinding of cemented carbide tools and high hardness steels it is desirable to make available grinding tools which can be used without a liquid lubricant or coolant since operators in most instances would prefer to grind dry thus avoiding the inconvenience and expense of providing a coolant source. Furthermore, the use of a coolant interferes with the observation, by the operator, of the grinding process.

The failure of ceramic bonded wheels to compete in this area is due to a severe loading which occurs on grinding. This, in turn, leads to high power loads, heating, and wheel breakdown or even breakage.

Grinding wheels employing ceramic bonds have recently been introduced which contain 40% or more carbon, a portion of which is graphite. These wheels have an open porosity 15% or more and are impregnated with a lubricant such as stearic acid which liquifies on the wheel surface during grinding. Such wheels have been found inadequate for grinding cemented carbides at conventional grinding rates for carbide grinding with diamond wheels.

This invention also relates to self-sharpening hones. Under desirable operating conditions for honing carbide most standard diamond hones do not perform in an optimum manner. Whether they are metal-, resinoid-, or vitrified-bonded, the standard product will cut freely for but a short while (after dressing) and then progressively exhibit a lower and lower rate of cut to the point where additional dressing is necessary in order to maintain an economical honing operation. Due to the high cost of labor, it is very desirable to maintain a high rate of cut (high rate of carbide removal) and reduce dressing to a minimum or even eliminate, if possible.

We have found that by introducing an "inert" second phase into a vitrified-bonded diamond hone, we can change the breakdown behavior of the bond so that a self-sharpening action is obtained; leading to constant high rates of carbide removal with little or no "dressing" in the normal sense being required.

The present invention provides a ceramic bonded grinding tool, having graphite included therein, which equals or significantly out-performs the presently commercially available wheels for the dry grinding of carbides. When the wheel includes cubic boron nitride abrasive particles it is equal to or better than commercially available grinding wheels in grinding efficiency and superior in its low power requirements, for the grinding of high hardness steels.

THE DRAWINGS

SUMMARY OF THE INVENTION

The grinding tool of the present invention includes a grinding element consisting of diamond or cubic boron nitride abrasive grits bonded by a ceramic matrix. Said ceramic matrix bond includes graphite in an amount of from 23 to 53% of the total bond volume for grinding wheels, and from 10 to 40% for hones (including the graphite). The porosity of the element is in any case below 15%, and for grinding wheels is below 10% (by volume), and is, desirably, as low as the fabrication technique permits. The graphite should be of high purity, preferably of the type referred to as "flake" graphite and should be less than 200 microns, numerical average particle size. As used herein particle size means the average of the longest and shortened dimensions of the flakes as they normally lie on a flat plane (that is, the thickness is disregarded).

Figure 1:
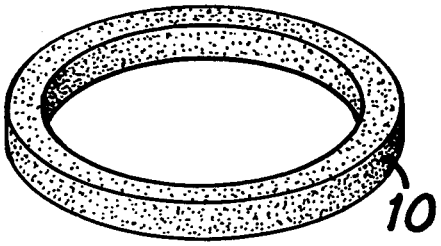
FIG. 1 shows a perspective view of a grinding element such as produced according to the present invention.
Figure 2:
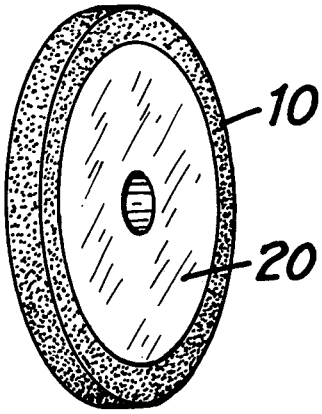
FIG. 2 shows a perspective view of the grinding element of FIG. 1 mounted for use.
Figure 3:
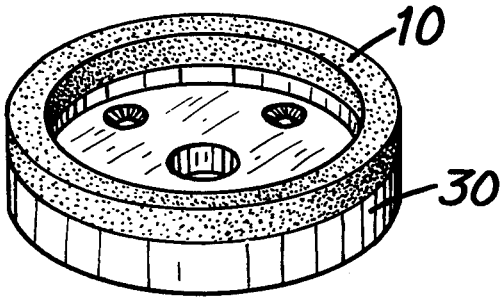
FIG. 3 shows a different method of mounting the grinding element of FIG. 1.

The grinding elements according to the present invention are mounted on supports such as shown in FIGS. 2 and 3 of the drawing to form grinding tools, such as grinding wheels of standard shape. FIG. 1 shows a typical grinding element 10. FIG. 2 shows the grinding element cemented to a core 20 to produce a straight grinding wheel. FIG. 3 shows the element 10 mounted on a cup shaped support to form a grinding wheel commonly referred to as a "cup-wheel". A suitable material for making the support member is aluminum-filled resin as disclosed in U.S. Pat. No. 2,150,886. Epoxy resins, preferably of good thermal conductivity, are convenient cements for joining the grinding element to the support or preform to produce the grinding tool.

The grinding element and its composition are discussed in more detail below.

THE BOND

The present invention relates solely to ceramic bonded elements and any of the many known glass bonds may be employed. Typically such bonds are made up of a glass containing silica, boron oxide, sodium oxide, aluminum oxide and alkali and alkaline earth metal oxides. It is preferred, but not essential, that such glasses include a micro-crystalline inorganic filler which is added to the glass composition prior to forming the tool or which is formed in situ by partial devitrification of the glass bond composition. When the micro-crystalline filler is added prior to forming, typical useful materials are silicon carbide, alumina, and zirconia. Such materials are useful up to a volume content of glass plus micro-crystalline filler of 60%. In the case of micro-crystals formed in situ by the devitrification process, the upper limit is above 90%; 5 to 10% of glass being sufficient to bond the crystals together.

THE GRAPHITE

Graphite is commercially available in various sizes and grades, both natural and synthetic. The graphite should be less than 200 microns numerical average particle diameter and, for best results should average from 1 to 10 microns. Graphite, as commercially available varies in crystallinity. The more highly crystalline the material is, the better it will perform in the present invention. Highly crystalline graphite is sold under the term "flake" graphite, and this form is preferred. Amorphous carbon does not produce the beneficial effects shown by graphite. For grinding wheels the operable graphite content of the bond ranges from 23% to 54% of the total bond contents by volume (glass, microcrystals, and graphite), is preferably from 27 to 45%, and the optimum graphite content ranges from 34 to 45%; for hones the preferred graphite content is from 10 to 40%.

THE ABRASIVE

The operative abrasives in the present invention are diamond and cubic boron nitride. The diamond may be natural or synthetic, and of various grits sizes and shapes, as is well known in the art.

The abrasive may be metal coated and when such abrasive is employed the coating should preferably be in the range of 10 to 60%, by volume, of the abrasive plus coating. Suitable metal coatings are copper, silver, nickel, cobalt, molybdenum and alloys thereof. In general, any metal melting above 500° F. which is chemically stable in the grinding tool may be used.

The abrasive content of the tool is not critical, but the practical range of diamond content is from 5 to 40% of the total tool volume.

FABRICATION OF THE ELEMENT

An essential feature of the present invention is the inclusion of not more than 10% total porosity, by volume, in the grinding element for grinding wheels, and below 15% for hones. So long as this criteria is maintained, the particular method of fabrication, i.e. cold pressing and sintering or hot pressing is of no consequence. Since, however, it is easier to minimize porosity by hot pressing the mix to the desired shape, such method is taught in the present application.

Thus, a mix of abrasive, glass forming materials (such as a powdered frit), and graphite are mechanically mixed and placed in a mold for pressing. A typical mix for making a ring 3/16" high, 4" outside diameter and 3¾" inside diameter, would be made as follows:

| Glass Frit | |
|---|---|
| Composition | Weight % |
| $SiO_2$ | 34.89 |
| $Al_2O_3$ | 28.45 |
| $Fe_2O_3$ | 0.47 |
| CaO | 0.22 |
| MgO | 7.15 |
| $Na_2O$ | 0.4 |
| $K_2O$ | 0.12 |
| $B_2O_3$ | 19.10 |
| $LiO_2$ | 8.32 |
| PbO | 0.71 |
| $TiO_2$ | 0.04 |

The above frit is ball-milled to an average particle size of 11 microns, and then mixed with nickel coated (55 wt. % nickel) diamond and graphite as follows:

| | |
|---|---|
| Nickel Coated Diamond | 6.40 Gms. |
| Glass Frit | 4.9 Gms. |

-continued

| | |
|---|---|
| Graphite | 2.31 Gms. |

The above composition is carefully mixed to a uniform state and placed in a graphite mold for hot-pressing. In a typical run the material was compressed initially at 0.3 tons per square inch while the temperature was raised to 500° C. This temperature was reached in 10 to 15 minutes and the pressure was raised to 1.5 tons per square inch and hold for approximately 10 minutes. The temperature was then raised to approximately 600° C. over a 10 to 20 minute period, and held for 10 minutes. The run was then terminated and the ring stripped hot from the graphite mold and air cooled. With the given frit and heated cycle, a partially devitrified bond is produced including microcrystals of beta-eucryptite as the principal crystalline phase in the bond. If desired, the devitrification step (holding at 600° C.) may be eliminated or a standard glass bond having a composition such as the following may be used:

| Standard Glass Bond | |
|---|---|
| $SiO_2$ | 66.9 |
| $Al_2O_3$ | 2.01 |
| CaO | 1.44 |
| $Na_2O$ | 5.29 |
| $B_2O_3$ | 24.31 |

When such a bond is employed up to 60%, by volume, of a filler such as silicon carbide, tungsten carbide, boron carbide, alumina, or zirconia may be employed, based on the glass plug carbide or oxide filler. The bond may be used without such filler if desired.

COMPARATIVE TESTS

In Example I, II, and III tests noted below, variations of the rotary grinding tools of the present invention were compared with a standard resinoid bonded grinding wheel of the prior art. No vitrified wheels without graphite were employed as standards since such wheels are, as a practical matter, unusable in the dry grinding of carbides or high hardness steels.

Three wheels were prepared using nickel coated diamond (150 grit), a devitrified glass bond as given the section above on fabrication, and containing varying proportions of flake graphite (finer than 325 mesh). The standard wheel was a resin bonded wheel containing 35% by volume of silicon carbide filler in the bond but no graphite. The grinding elements contained 18¼ volume percent of diamond except test item 3 which contained only 17¾%, by volume of diamond, and the resinoid standard which contained 16% diamond. The wheels were cup-wheels (type D6A9) 4×1¾×1¼".

The grinding machine was a Norton S-3, 6×18" surface grinder with automated cross-feed, index and shutdown modifications, operating as follows:

Wheel Speed: 3800 surface feet per minute
Table Traverse: 100 inches per minute
Unit In-Feed: 2.0 mils
Material Ground: 44A Carboloy (cemented tungsten carbide)
Operation: Dry grinding The results were as follows:

| | % Graphite in Bond Vol. % | Porosity Vol. % | G Ratio | Power Drawn |
|---|---|---|---|---|
| Example I | 27 | 3.5 | 101 | 1325 |
| Example II | 41 | 5.1 | 303 | 795 |
| Example III | 48-½ | 7.8 | 47 | 500 |
| Standard | — | — | 33 | 1130 |

The "G Ratio" represents the total volume of material ground divided by the total volume of wheel wear. The power drawn is measured by a wattmeter in the power line on the motor driving the wheel.

EXAMPLES IV, V, VI, and VII

A similar test on a harder cemented carbide was performed using a standard glass bond, as given in the fabrication section above, with various levels of silicon carbide filler in the glass bond. The graphite content was 35%, by volume, and the silicon carbide content is given in the table of results.

| | SiO Vol. % | Graphite Vol. % | G | Power |
|---|---|---|---|---|
| Resinoid Standard | 35 | — | 20 | 1275 |
| Example IV | 7 | 35 | 45.7 | 915 |
| Example V | 13 | 35 | 62.8 | 990 |
| Example VI | 20 | 35 | 48.0 | 800 |
| Example VII | 26 | 35 | 52.0 | 865 |

When metal coated cubic boron nitride is substituted for diamond, the grinding elements of this invention give improved performance in the grinding of hard tool steels.

HONING STICK COMPOSITIONS

Compositions of our experimental items were as follows:

| | Volume Percent | |
|---|---|---|
| | Uncoated Diamond | Metal-Coated Diamond |
| Abrasive | 21 | 33 |
| Bond | 39-61 | 37-51 |
| Graphite | 7-85 | 10-26 |
| Pores | 5-19 | 5-11 |

(a) Abrasive: 220 grit diamond abrasive was used. Both natural and synthetic, uncoated diamond as well as metal-coated manmade diamond were employed. The synthetic-diamond was General Electric RVG and the metal-coated was General Electric, ASD, with approximately 55 weight percent coating. Although only 85 concentration items were tested, there is no reason to believe that concentration would place any limitation on performance; using graphite as above.

(b) Bond: The bond was obtained in powdered form and ball-milled to an average particle size of approximately 11 micron (20 micron) for use with fine (−325 mesh) graphite. Screened, as-received material was used with coarser graphite. The composition of the as-received frit was as follows:

| Glass Frit | |
|---|---|
| $SiO_2$ | 34.89 Wt. % |
| $Al_2O_3$ | 28.45 |
| $Fe_2O_3$ | 0.47 |
| CaO | .22 |

-continued

| Glass Frit | |
|---|---|
| MgO | 7.15 |
| $Na_2O$ | .40 |
| $K_2O$ | .12 |
| $B_2O_3$ | 19.10 (by difference) |
| $Li_2O$ | 8.32 |
| PbO | .71 |
| $TiO_3$ | .04 |
| Loss | .13 |
| | 100.00 |

(c) Graphite: The graphite (Asbury Mills, Inc.) used was either a blocky, porous (density of approximately 1.92 g/cc) material or a flaky, dense (2.26 g/cc) powder. The porous material was used in a particle size finer than 150 mesh while dense material was −325 mesh.

(d) Typical compositions are as follows:

| | | Bond/Graphite by Vol. | | | |
|---|---|---|---|---|---|
| Uncoated Diamond | | 4.88 | 3.19 | 2.26 | 1.66 |
| Abrasive | (gm) | 1.444 | 1.444 | 1.444 | 1.444 |
| Bond | (gm) | 2.843 | 2.600 | 2.373 | 2.139 |
| Graphite | (gm) | 0.533 | 0.746 | 0.964 | 1.178 |
| Metal-Coated Diamond | | | | | |
| Abrasive | (gm) | 3.233 | 3.233 | 3.233 | 3.233 |
| Bond | (gm) | 2.382 | 2.181 | 1.986 | 1.789 |
| Graphite | (gm) | 0.446 | 0.626 | 0.806 | 0.985 |

The above materials were mixed by stirring in a beaker and screened 4 times through a metal, 72 mesh screen. They were then placed in a graphite mold of suitable design to yield fired pieces of approximately ⅛" wide×1¾" long×0.090" thick. In some molds, the samples were arranged in the same plane for hot pressing with individual plungers for each sample. In other molds, a rectangular plate approximately ¾"×1¾"×0.090 was formed with indentations formed by properly shaped plungers. Cracking of the fired plate along the indentations then yielded the proper width hone. In order to improve molding, metal plungers were used in conjunction with a graphite mold band. And in the last series of hones prepared, an all steel construction was used. However, wherever metal surfaces were exposed to mating metal surfaces or to the sample such surfaces were either pointed or sprayed with graphite to prevent sticking.

HOT-PRESSING PROCEDURE

The loaded mold assembly was placed in a resistance-type furnace into which $N_2$-gas was introduced in an effort to minimize oxidation of the mold.

The mold was then heated to approximately 500° C. (Sometimes the material was compressed during heating to a temperature—at 0.3 tons per square inch). This temperature was reached in 30–40 minutes and a compacting pressure of 0.6 to 1.5 tons per square inch was applied and held for approximately 10 minutes. The temperature was then raised to approximately 600° C. over a 10–30 minute period; the pressure being maintained all the while at the compacting pressure. Pressure was held at 600° C. for approximately 10 minutes. The run was then terminated; the pressure being released and the samples stripped hot from the mold and air cooled.

The fired pieces had good dimensional features; capable of being easily lapped to finish size. The hone had one curved side. In some molds, the plungers were shaped on the proper radius (3/16") to yield the proper curvature on firing with no subsequent finishing required (on this surface).

The properly dimensioned hone was then cemented to a metal mandrel with a suitable adhesive (epoxy) which, in turn, could be mounted on the test equipment—Sunnen Products Co. (St. Louis, Missouri) Precision Honing Machine, MBB-1600.

| Test Conditions | |
|---|---|
| Mandrel | K12-479AH |
| Speed | 1,600 RPM |
| Pressure | Variable, within the setting of the machine |
| Stroke Length | 2-½" |
| Stroke Frequency | 120/min. |
| Workpiece | ¾" O.D. × 1-¼" length × 0.370-0.500" I.D., 44A Carbide. |

OBJECT

To determine how many of the above described carbide pieces can be honed at a stock removal rate of at least 0.007"/min. on the I.D.; 0.002" being removed from each piece.

RESULTS

The following data relate to actual experimental items (containing graphite) tested as above. In addition to G-Ratio there is given the number of pieces honed (without recourse to dressing) within the prescribed stock removal rate. It is to be noted that this latter figure is not a limitation but merely denotes the point at which testing was terminated. Compared to the values for standard hones given previously, it clearly illustrates the self-sharpening or self-dressing superiority of the experimental hones.

| | Vol. % Graphite In Bond | G-Ratio | No. of Pieces Honed |
|---|---|---|---|
| A. Asbury 11X/14X Graphite, JD (G.E. Manmade virgin RVG) diamond | | | |
| H-1 | 30 | 33 | 71 + |
| B. Asbury, FG, -325 Graphite | | | |
| (1) JD diamond | | | |
| H-2 | 18 | 96 | 50 + |
| H-3 | 24 | 65 | 51 + |
| H-4 | 31 | 53 | 115 + |
| (2) PD (natural, strong shape) | | | |
| H-5 | 24 | 38 | 147 + |
| H-6 | 24 | 52 | 115 + |
| (3) ASD (nickel-coated RVG) | | | |
| H-7 | 24 | 35 | 87 + |
| H-8 | 31 | 42 | 56 + |

The experimental items containing graphite, at 10 to 40% by volume in the bond and containing less than 15% by volume of porosity permit honing at a satisfactory stock removal rate of at least 8 times the number of carbide pieces possible with standard bonded products.

The bond used here for the experimental samples was a glass-ceramic; requiring the specified heat treatment for sintering and crystallization. Ordinary glasses with little or no devitrified content can also be employed.

MODIFICATIONS

Although graphite is preferred for optimum general results, as substitutes for all or part of the graphite, molybdenum disulfide or hexagonal boron nitride or mixtures thereof, within the same particle size range as specified for the graphite, may be employed. Metal powder such as silver, copper, aluminum, or tin, in that order of preference, may be used to replace as much as 50%, by volume of the graphite (or graphite substitute) fillers. The metal should also be finely particulate in the range of sizes specified for the graphite or graphite substitute.

What is claimed is:

1. A bonded abrasive grinding element consisting of abrasive grains distributed in a continuous ceramic bonding matrix said abrasive grains comprising diamond or cubic boron nitride and said bond consisting essentially of a ceramic matrix including from 10 to 53%, by volume, of graphite or a graphite substitute selected from hexagonal boron nitride, or molybdenum, disulfide or mixtures thereof, having a numerical average particle size of less than 200 microns, said grinding element including less than 10% porosity, by volume.

2. A grinding element as in claim 1 in which the graphite is flake graphite having a particle size of from 1 to 10 microns and is present in an amount of from 27 to 45%, by volume of the bond.

3. A grinding element as in claim 1 in which the bond is a devitrified glass containing microcrystalline particles crystallized in situ, based on the total volume of glass and microcrystals.

4. A grinding element as in claim 1 in which the ceramic bond contains up to 60% of the total bond volume exclusive of graphite, of a microcrystalline filler selected from the group consisting of alumina and silicon carbide.

5. A grinding element as in claim 1 in which the abrasive grains are diamond.

6. A grinding element as in claim 1 in which the abrasive grains are cubic boron nitride.

7. A grinding element as in claim 1 in which from 0 to 50% by volume of the graphite or graphite substitute is replaced by a finely particulate metal filler selected from the group consisting of silver, copper, aluminum, and tin.

8. A grinding element as in claim 1 in which the abrasive is metal clad diamond, the metal cladding being selected from the group consisting of copper, silver, nickel, cobalt, molybdenum, and alloys thereof, the graphite has a particle size of from 1 to 10 microns and is flaky in form, the volume of porosity is below 10%, and the diamond volume is from 5 to 40%, of the total element volume.

9. A ceramic bonded multipoint diamond abrasive element wherein the bond contains from 34 to 45%, by volume of graphite having a particle size less than 200 microns, and wherein said element has a porosity of less than 10%.

* * * * *